US011408696B2

(12) United States Patent
Gerlings

(10) Patent No.: US 11,408,696 B2
(45) Date of Patent: Aug. 9, 2022

(54) FIREARM GAS SYSTEM EXTENSION

(71) Applicant: Phillip Gerlings, Gilbert, AZ (US)

(72) Inventor: Phillip Gerlings, Gilbert, AZ (US)

( * ) Notice: Subject to any disclaimer, the term of this patent is extended or adjusted under 35 U.S.C. 154(b) by 0 days.

(21) Appl. No.: 17/380,646

(22) Filed: Jul. 20, 2021

(65) Prior Publication Data

US 2022/0026166 A1 Jan. 27, 2022

Related U.S. Application Data

(60) Provisional application No. 63/056,267, filed on Jul. 24, 2020.

(51) Int. Cl.
*F41A 5/28* (2006.01)

(52) U.S. Cl.
CPC ..... *F41A 5/28* (2013.01)

(58) Field of Classification Search
CPC ..... F41A 5/28
USPC ..... 89/191.01, 193
See application file for complete search history.

(56) References Cited

U.S. PATENT DOCUMENTS

2014/0224114 A1* 8/2014 Faxon ..... F41A 5/28
89/193

* cited by examiner

*Primary Examiner* — Reginald S Tillman, Jr.

(57) ABSTRACT

An attachable extension can be attached to a firearm adjustment knob comprising an extension rod and a mounting block wherein the extension rod can slide back and forth axially and rotatably within the mounting block. A knob mounted to the extension rod and a spring mounted around the extension rod for biasing the extension rod toward a gas exhaust knob, and a fastener capturing the mounting block to a barrel shroud wherein the knob movably rotates the extension rod axially within the mounting block. The extension rod further comprises a slot fitted over gas exhaust knob. The extension rod can be coupled to the knob by a pin.

17 Claims, 7 Drawing Sheets

FIREARM GAS SYSTEM EXTENSION

CROSS-REFERENCE TO RELATED APPLICATIONS

This application claims benefit from currently pending U.S. Provisional Application No. 63/056,267 titled "Firearm Gas System Extension" and having a filing date of Jul. 24, 2020, all of which is incorporated by reference herein.

TECHNICAL FIELD

The present invention relates to an extension device and more particularly relates to a gas extension device that can attach to an existing gas system and extend it beyond a handguard or barrel shroud for easy access.

BACKGROUND OF THE INVENTION

In gas operated type firearms, the propellant gases are tapped from the barrel and are employed to drive a piston back which actuates the gun action. It is often desirable to have some means of regulating the energy transmitted to the piston. This is especially desirable in firearms that are adapted to fire a variety of types of ammunition, each developing widely varying pressure characteristics in the barrel. If no control device is provided to compensate for the varying pressure, the gun must be designed to function with that round of ammunition which develops the least gas pressure energy on the operating piston. When firing rounds with high pressure levels, excessive energy is transmitted to the action which tends to increase wear and tear and shorten the life of the firearm.

Current methods of compensating for the varying pressure include adjusting the pressure within the system by turning a knob that adjusts the volume within the gas piston system. The adjustment knob is usually located next to the gas piston system near the middle or back of the barrel which requires the user to remove the barrel shroud to turn the knob or requires the aft top portion of the barrel shroud to cut out for easy access. These designs require the user to purchase certain types of barrel shrouds, or do not allow the user to quickly adjust the pressure because the user has to remove pieces to adjust the pressure.

Accordingly, an improved system and method for adjusting gas pressure in a piston is needed that allows the user to easily access and rotate the knob for different size barrel shrouds.

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicant(s) will amend the specification to expressly recite the essential material that is incorporated by reference as allowed by the applicable rules.

BRIEF SUMMARY OF THE INVENTION

An attachable extension to a gas exhaust knob in a barrel shroud in a firearm gas system, the extension comprising an extension rod and a mounting block wherein the extension rod can slide back and forth axially and rotate relative to the mounting block. An extension knob coupled to the extension rod allowing a user to rotate the extension rod relative to the mounting block A spring coupled to the extension rod biasing the extension rod toward the gas exhaust knob. A fastener coupled to the mounting block to secure the mounting block to the barrel shroud.

The extension rod can further comprise a slot that at least partially accommodates the gas exhaust knob and the extension rod can be coupled to the extension knob by a pin. The mounting block can comprise a mounting block extension, a mounting block attachment point, a mounting block hole, and a location pin. The fastener is secured to the barrel shroud at the mounting block attachment point. The extension rod further comprises a shoulder wherein the spring pushes against the mounting block and a shim which reacts against the shoulder of the extension rod keeping the extension rod in contact with the gas exhaust knob. The exhaust knob comprises a leverage slot. The leverage slot is sized to fit a standard ammunition round to allow the ammunition round to be use as a wrench to rotate the exhaust knob. The extension rod has an adjustable length. The extension rod extends telescopically.

A method of extending a gas exhaust knob in a barrel shroud in a firearm gas system, the method comprising the acts of coupling an extension rod to a mounting block such that the extension rod can slide back and forth axially and rotate relative to the mounting block, securing the mounting block to the barrel shroud, biasing the extension rod coupled to the mounting block toward the gas exhaust knob, and engaging the gas exhaust knob with the extension rod such that rotating the extension rod causes the gas exhaust knob to rotate. The extension rod can rotate via an extension knob.

The extension rod can engage the gas exhaust knob by a slot that at least partially accommodates the gas exhaust knob. The exhaust knob can comprise a leverage slot. The object can be inserted into the leverage slot to give the user greater leverage in rotating the extension knob, wherein the object is a standard ammunition round. The leverage slot can be sized to fit a standard ammunition round to allow the ammunition round to be use as a wrench to rotate the exhaust knob.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U. S. C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112 (f). Moreover, even if the provisions of 35 U.S.C. § 112 (f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWINGS

A more complete understanding of the present invention may be derived by referring to the detailed description when considered in connection with the following illustrative figures. In the figures, like reference numbers refer to like elements or acts throughout the figures.

Figure 1:
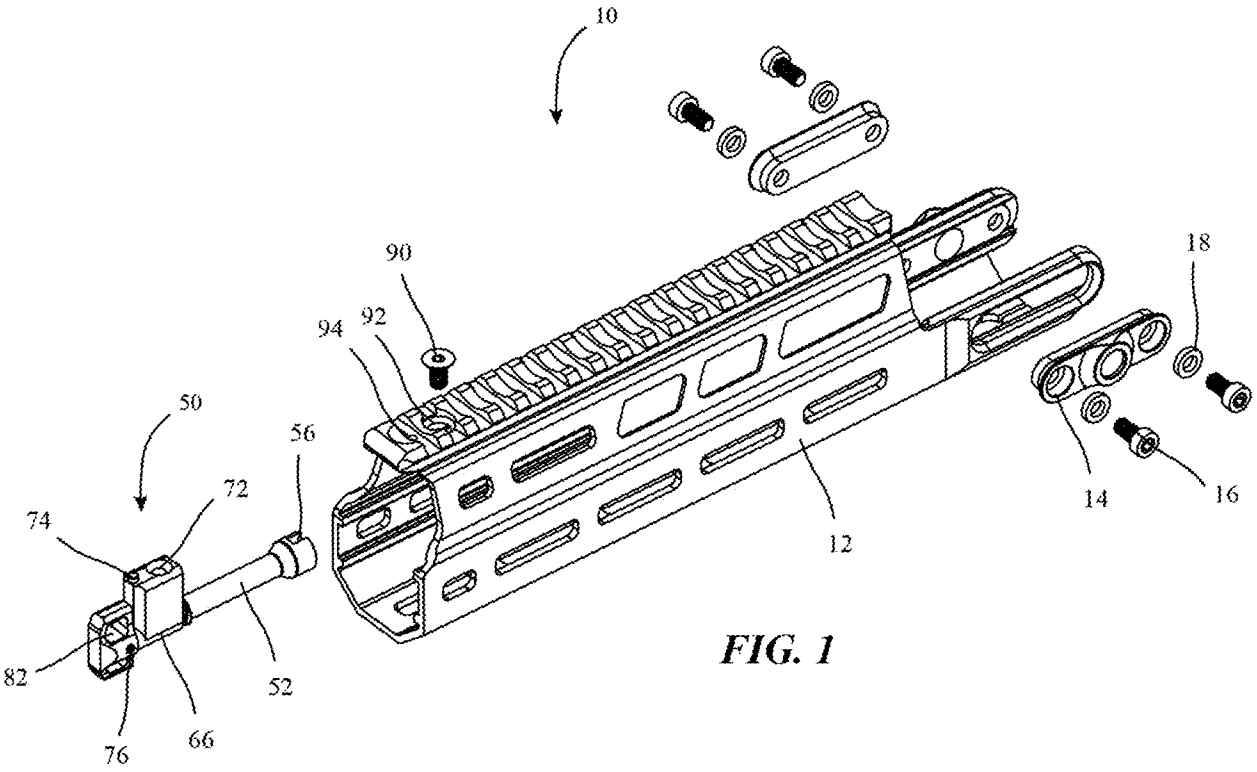
FIG. 1 is an exploded isometric view of firearm gas system extension and barrel shroud in accordance to one, or more embodiments.
Figure 2:
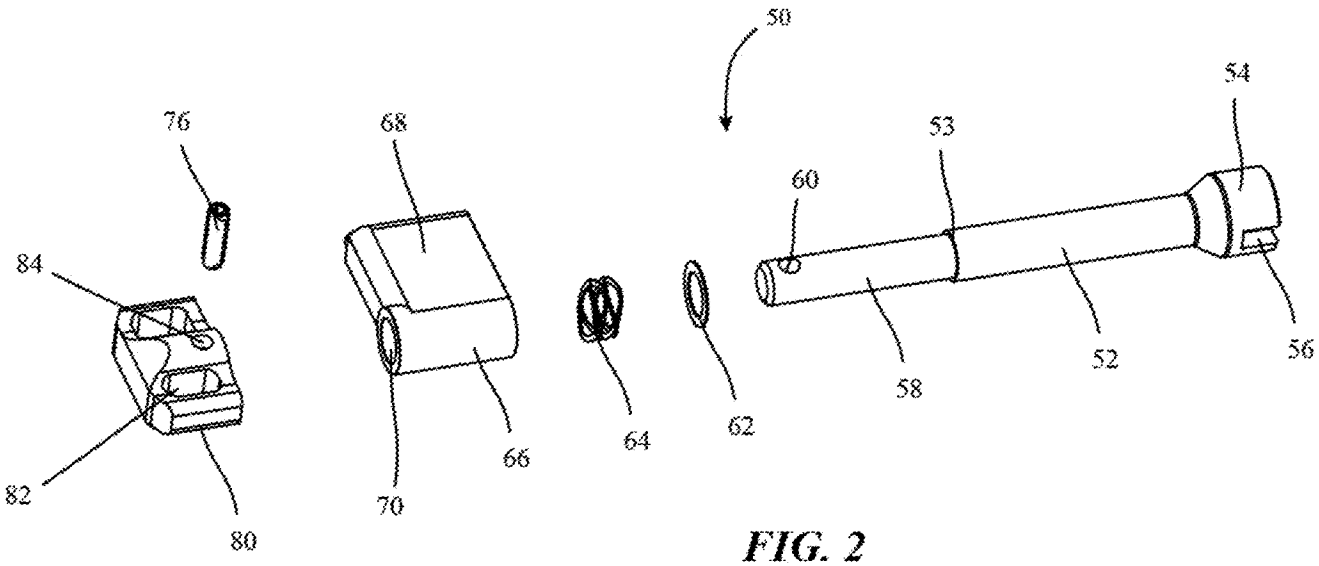
FIG. 2 is an exploded isometric view of firearm gas system extension in accordance to one, or more embodiments.
Figure 3:
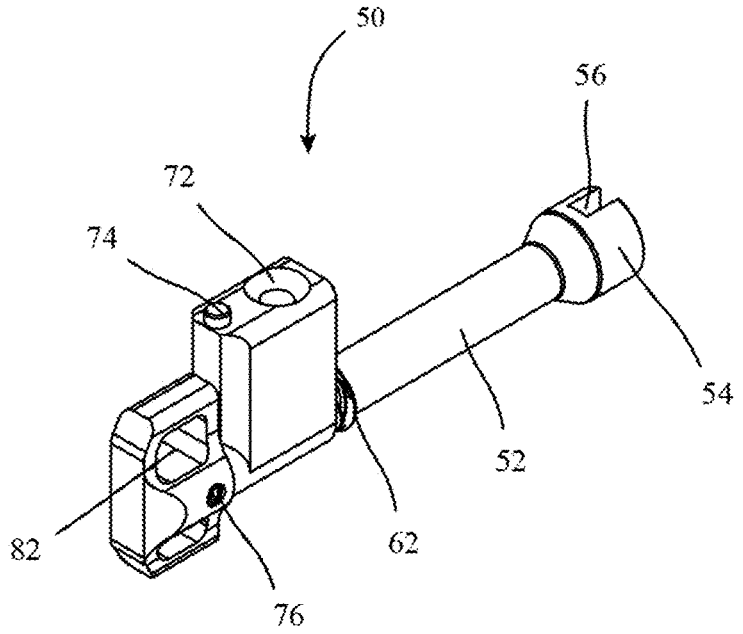
FIG. 3 is an isometric view of firearm gas system extension in accordance to one, or more embodiments.
Figure 4:
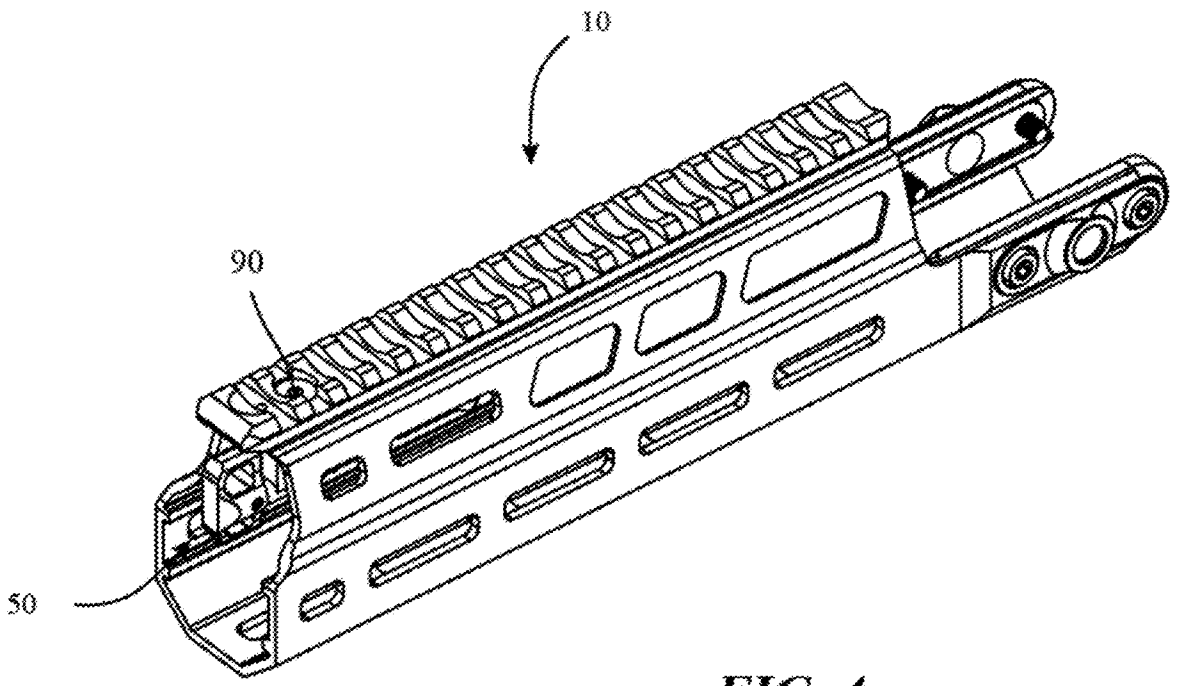
FIG. 4 is an isometric view of firearm gas system extension installed on the barrel shroud in accordance to one, or more embodiments.
Figure 5:
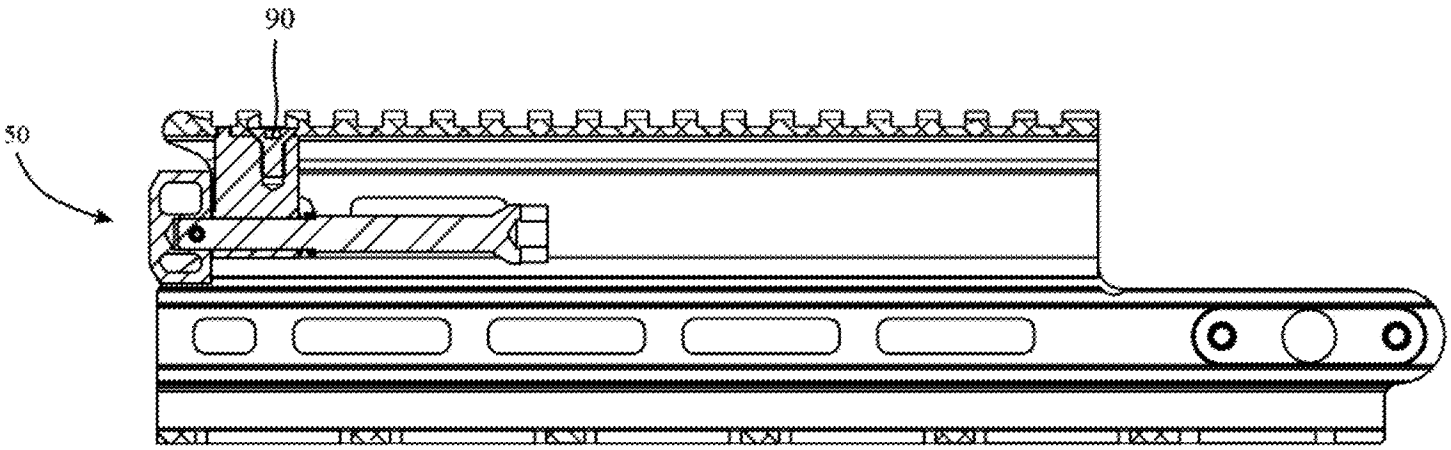
FIG. 5 is a cross sectional view of firearm gas system extension installed on the barrel shroud in accordance to one, or more embodiments.
Figure 6:
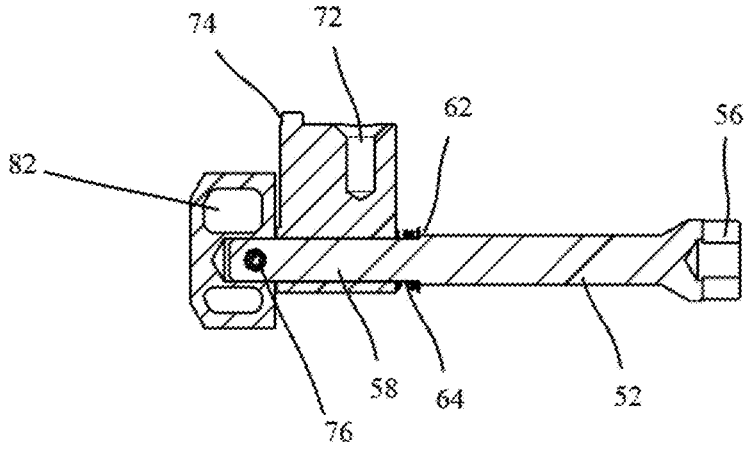
FIG. 6 is a cross sectional view of firearm gas system extension in accordance to one, or more embodiments.
Figure 7:
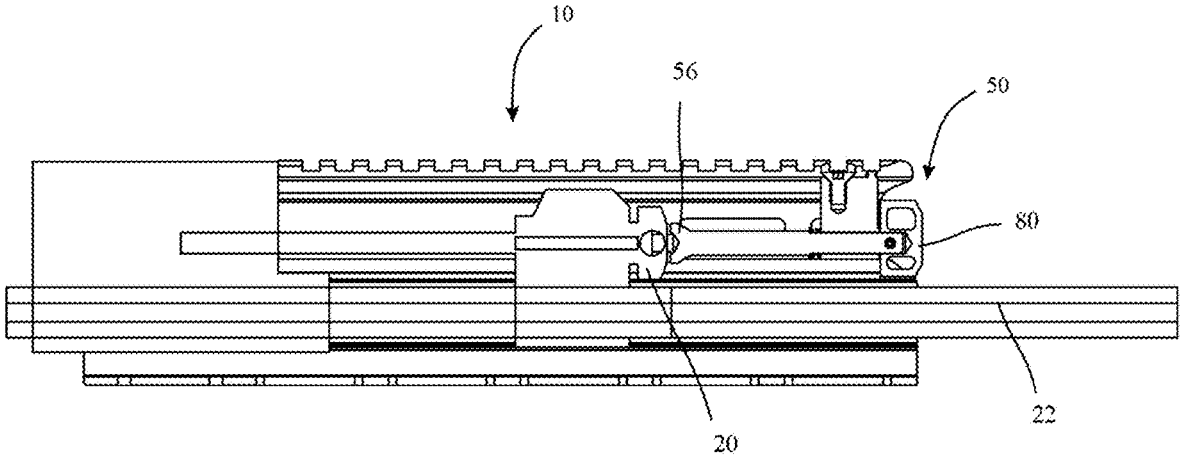
FIG. 7 is a cross sectional view of firearm gas system extension installed on the barrel shroud connected to an adjustment knob on the firearm in accordance to one, or more embodiments.
Figure 8:
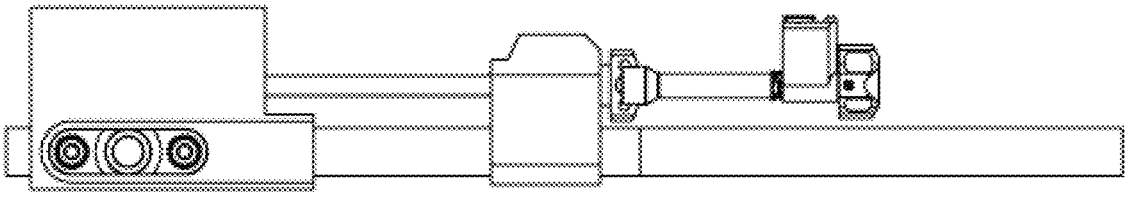
FIG. 8 is a view of firearm gas system extension connected to an adjustment knob on the firearm without the barrel shroud in accordance to one, or more embodiments.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Referring initially to FIG. 1 through FIG. 8, a attachable extension to a gas exhaust knob in a barrel shroud in a firearm gas system shown generally at 10. The attachable extension 50 comprises an extension rod 52 and a mounting block 66 wherein the extension rod can slide back and forth axially and rotate relative to the mounting block. An extension rod 52 can have a shoulder 53 wherein a shim 62 can be placed against the shoulder and can act as a reaction point for a spring 64 to push against. The shim 62 can be a washer, shim, bearing shim, or the like. The extension rod 52 can further comprise a slot 56 wherein the slot can be removably attached to or connected to, or encapsulate an gas exhaust knob 20 which is a part of the gun's gas exhaust system wherein the slot can at least partially accommodate the gas exhaust knob 20. The spring 64 allows for the extension rod 52 to move back and forth axially allowing for the gas exhaust 20 to rotate in and out or for slop within the fit between the extension rod and the gas exhaust knob. The spring 64 can also keep a constant force between the extension rod and the gas exhaust knob 20. Further a spring 64 mounted around the extension rod 52 can be for biasing the extension rod toward a gas exhaust knob 20. The spring 64 can be a wave spring, conical spring, compression spring, Belleville spring, or the like.

The extension rod 52 can take on any shape, or length but the preferred shape is circular with a shoulder 53, wherein the shoulder can be substantially closer to the forward end 58, near the middle or substantially closer to the aft end wherein the forward end can be smaller, or in other embodiments larger in diameter than the aft end. The extension rod can have an aft end 54 that can have a diameter that gradually increases to accommodate the slot 56 and on the forward end 58 the diameter can be smaller to accommodate a shoulder between the aft and forward ends. The forward end 58 can have a pin hole 60 substantially near the front of the forward end. In certain embodiments the extension rod 52 can be the same diameter, can vary in diameter from the forward end 58 to the aft end 54, or the forward end can be larger than the aft end or the aft end can be larger than the forward end. The extension rod 52 can be manufactured from such as, for example, stainless steel, aluminum, carbon steel, zinc, copper, red brass, or the like or plastics such as Delrin, polypropylene, high density polyethylene, polyvinyl chloride, or the like. The extension rod 52 length can accommodate any length of barrel shroud, handguard, gas system, or any other firearm component that would affect the length the user getting access to the gas system knob 20. In certain embodiments, the extension rod 52 can be a machined, molded, casted or made one part.

The mounting block 66 can comprise a mounting block attachment hole 70, a mounting block extension 68, a mounting block attachment point 72, and a location pin 74. The extension rod 52 aft end can slide through the mounting block attachment hole 70 wherein the mounting block attachment hole allows for the extension rod to move axially back and forth and rotate around its axis freely around and through the forward end of the extension rod. The mounting block 66 is stationary when attached to the barrel shroud 12 allowing the extension rod 52 to move forward and aft when adjusting the gas system of the gun. The mounting block 66 can be coupled to the barrel shroud 12 or handguard by at least one fastener 90 wherein the barrel shroud can have an alignment hole 94 and a at least one fastener hole 92 for the mounting block attach to in which the fastener can be inserted into the fastener hole and screwed or inserted into the mounting block attachment point. In the preferred embodiment, the mounting block 66 can be secured and aligned to the barrel shroud 12 by the alignment hole 94 and location pin 74 wherein the location pin can be partially, or fully inserted into the alignment hold. In certain embodiments the location pin 74 and alignment hole can be omitted. In other embodiments, the mounting block 66 can be attached to the barrel, the gas exhaust system knob, or any other component of the firearm using a clamp, sleeve, fastener or interface type fit. The mounting block 66 extension can vary in shape, length and size to accommodate different size firearms, barrel shrouds, exhaust gas system, and barrels. The mounting block attachment hole 70 can accommodate any shape or size of the extension rod 52. The spring 64 can push against or react against the mounting block 66 providing a set position for the extension rod 52 to move axially and rotate within. The mounting block 66 can be manufactured from such as, for example, stainless steel, aluminum, carbon steel, zinc, copper, red brass, or plastics such as Delrin, polypropylene, high density polyethylene, polyvinyl chloride, or the like. The firearm gas system extension 50 can be connected directly to the gas system knob 20 or to the gas system mechanism itself by such as, for example, screws, pins, or it could be attached using a sleeve or interference type fit. In certain embodiments, the mounting block 66 can be clamped, glued, pinned, or the like to the barrel shroud 12. The barrel shroud 12 can be attached to the gun by an adapter 14 by a fastener 16 and a washer 18. The barrel shroud 12 can be adapted to fit any type of gun.

The firearm gas system extension 50 can further comprise an extension knob 80 coupled to the forward end 58 of the extension rod 52 wherein the knob can comprise a hole 84 and at least one leverage slots 82. The extension knob can allow a user to rotate the extension knob 52 relative to the mounting block 66. The extension knob 80 can be attached to the extension rod 52 through the pin hole 60 and a hole 84 on the knob by a dowel pin 76 and in other embodiments the knob can be attached by press fit, loose fit, cotter pin, or any other mechanism that secures the knob to the extension rod. The extension rod 50 can be adjustable in length to accommodate different size guns and exhaust systems and the extension rod can extend telescopically. The dowel pin 76 can be such as, for example a dowel pin, roll pin, screw, bolt, or any type of fastener that can secure the extension knob 80 to the extension rod 52. The leverage slot 82 can be sized to fit any size standard ammunition round for any type of firearm so that the round can be used as a wrench and provide leverage to rotate the extension rod and in turn rotate the exhaust knob 20 and the gas exhaust system. In other embodiments the leverage slot 82 can be sized or shaped for a wrench, screwdriver, socket wrench, or the like so that the extension rod 52 can be easily rotated adjusting the gas pressure within the firearm. The extension knob 80 can be manufactured from such as, for example, stainless steel, aluminum, carbon steel, zinc, copper, red brass, or plastics such as Delrin, polypropylene, high density polyethylene, polyvinyl chloride, or the like.

In other embodiments the gas system adjustment mechanism could itself be extended allowing the user to easily access the gas system adjustment mechanism in front of the barrel shroud. The extension rod 52 and mounting plate 66 or any combination thereof can be attached the barrel shroud 12, the barrel 22, and gas exhaust knob 20 or any combination thereof.

In embodiments a method of extending a gas exhaust knob 20 in a barrel shroud 12 in a firearm gas system, the method comprising the acts of coupling an extension rod 52 to a mounting block 66 such that the extension rod can slide back and forth axially and rotate relative to the mounting block, securing the mounting block to the barrel shroud, biasing the extension rod coupled to the mounting block toward the gas exhaust knob 20, and engaging the gas exhaust knob with the extension rod such that rotating the extension rod causes the gas exhaust knob to rotate. The extension rod 52 can rotate via an extension knob 80. The extension rod 52 can engage the gas exhaust knob 20 by a slot 56 that at least partially accommodates the gas exhaust knob. The extension knob 80 can comprise a leverage slot 82. The object can be inserted into the leverage slot 82 to give the user greater leverage in rotating the extension knob, wherein the object is a standard ammunition round. The leverage slot 82 can be sized to fit a standard ammunition round to allow the ammunition round to be use as a wrench to rotate the exhaust knob.

Figure 9:
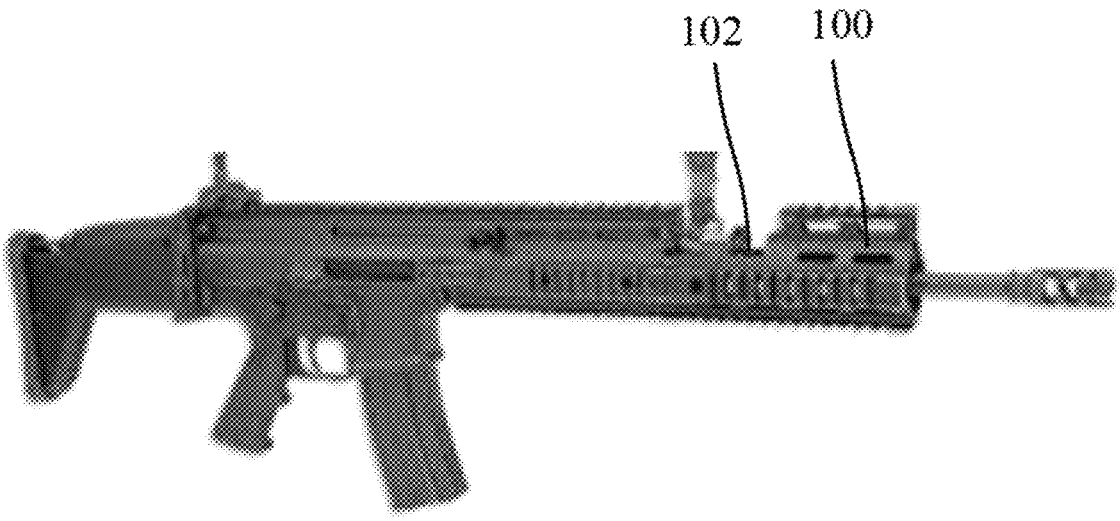
FIG. 9 is a prior art view of a firearm gas system.

Referring to FIG. 9, shows a prior art firearm with current barrel shroud 100 with a cut-out 102 to access the gas system, which makes it hard for the user to adjust the exhaust gas pressure of the firearm.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only and is not intended to limit the scope of the present disclosure, which is defined solely by the claims. Accordingly, embodiments of the present disclosure are not limited to those precisely as shown and described.

Certain embodiments are described herein, including the best mode known to the inventors for carrying out the methods and devices described herein. Of course, variations on these described embodiments will become apparent to those of ordinary skill in the art upon reading the foregoing description. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

I claim:

1. An attachable extension to a gas exhaust knob in a barrel shroud in a firearm gas system, the extension comprising:

an extension rod and a mounting block wherein the extension rod can slide back and forth axially and rotate relative to the mounting block;

an extension knob coupled to the extension rod allowing a user to rotate the extension rod relative to the mounting block;

a spring coupled to the extension rod biasing the extension rod toward the gas exhaust knob; and a fastener coupled to the mounting block to secure the mounting block to the barrel shroud.

2. The extension according to claim 1, wherein the extension rod further comprises a slot that at least partially accommodates the gas exhaust knob.

3. The extension according to claim 1, wherein the extension rod is coupled to the extension knob by a pin.

4. The extension according to claim 1, wherein the mounting block comprises a mounting block extension, a mounting block attachment point, a mounting block hole, and a location pin.

5. The extension according to claim 4, wherein the fastener is secured to the barrel shroud at the mounting block attachment point.

6. The extension according to claim 1, wherein the extension rod further comprises a shoulder wherein the spring pushes against the mounting block and a shim which reacts against the shoulder of the extension rod keeping the extension rod in contact with the gas exhaust knob.

7. The extension according to claim 1 wherein the extension knob comprises a leverage slot.

8. The extension according to claim 7 wherein the leverage slot is sized to fit a standard ammunition round to allow the ammunition round to be use as a wrench to rotate the exhaust knob.

9. The extension according to claim 1 wherein the extension rod has an adjustable length.

10. The extension according to claim 9 wherein the extension rod extends telescopically.

11. A method of extending a gas exhaust knob in a barrel shroud in a firearm gas system, the method comprising the acts of:

coupling an extension rod to a mounting block such that the extension rod can slide back and forth axially and rotate relative to the mounting block;

securing the mounting block to the barrel shroud;

biasing the extension rod coupled to the mounting block toward the gas exhaust knob; and engaging the gas exhaust knob with the extension rod such that rotating the extension rod causes the gas exhaust knob to rotate.

12. The method according to claim 11 further comprising rotating the extension rod via an extension knob.

13. The method according to claim 11 wherein the extension rod engages the gas exhaust knob by a slot that at least partially accommodates the gas exhaust knob.

14. The method according to claim 11 wherein the extension knob comprises a leverage slot.

15. The method according to claim 14 further comprising inserting an object into the leverage slot to give the user greater leverage in rotating the extension knob.

16. The method according to claim 14 wherein the leverage slot is sized to fit a standard ammunition round to allow the ammunition round to be use as a wrench to rotate the exhaust knob.

17. The method according to claim 15 wherein the object is a standard ammunition round.

* * * * *